US012378041B2

(12) United States Patent
Li et al.

(10) Patent No.: US 12,378,041 B2
(45) Date of Patent: Aug. 5, 2025

(54) INTEGRATED LEAKPROOF CUP COVER FOR DIRECT DRINKING AND DRINKING WITH STRAW AND CUP HAVING SAME

(71) Applicant: Yongkang Baoshi Industry and Trade Co., Ltd., Jinhua (CN)

(72) Inventors: Yalei Li, Jinhua (CN); Ran Zhang, Jinhua (CN)

(73) Assignee: Yongkang Baoshi Industry and Trade Co., Ltd., Jinhua (CN)

( * ) Notice: Subject to any disclaimer, the term of this patent is extended or adjusted under 35 U.S.C. 154(b) by 0 days.

(21) Appl. No.: 18/346,275

(22) Filed: Jul. 3, 2023

(65) Prior Publication Data

US 2023/0348151 A1 Nov. 2, 2023

(30) Foreign Application Priority Data

May 19, 2023 (CN) ..... 202321224331.4

(51) Int. Cl.
*A47G 21/18* (2006.01)
*B65D 43/02* (2006.01)

(52) U.S. Cl.
CPC ..... *B65D 43/0229* (2013.01); *B65D 2543/00046* (2013.01); *B65D 2543/00953* (2013.01)

(58) Field of Classification Search
CPC ..... A47G 19/2272; A47G 21/18; B65D 43/0229; B65D 2543/0046; B65D 2543/00953; B65D 47/26; B65D 47/261; B65D 47/265
USPC ..... 220/713, 254.3, 259.3
See application file for complete search history.

(56) References Cited

U.S. PATENT DOCUMENTS

| | | | | |
|---|---|---|---|---|
| 4,711,365 | A * | 12/1987 | Fomby | B65D 41/0428 215/DIG. 1 |
| 2007/0017925 | A1 | 1/2007 | Karr | |
| 2007/0095845 | A1* | 5/2007 | Auer | A47G 19/2272 220/837 |
| 2008/0142519 | A1 | 6/2008 | Chou | |
| 2011/0198349 | A1* | 8/2011 | Lane | A47G 19/2272 220/203.19 |
| 2012/0205371 | A1* | 8/2012 | Lee | B65D 47/286 220/8 |
| 2019/0112112 | A1* | 4/2019 | Choltco-Devlin | B65D 47/265 |
| 2020/0060453 | A1* | 2/2020 | Wang | B65D 51/1688 |
| 2021/0354888 | A1* | 11/2021 | Wong | B65D 47/061 |

* cited by examiner

*Primary Examiner* — Don M Anderson
*Assistant Examiner* — Elizabeth J Volz
(74) *Attorney, Agent, or Firm* — Hemisphere Law, PLLC; Zhigang Ma

(57) ABSTRACT

The present invention discloses an integrated leakproof cup cover for direct drinking and drinking with a straw and a cup having the same. The cup cover comprises a cup cover body and a slider body, and the bottom wall of the cup cover body is provided with a central through hole and a drinking port; the bottom of the cup cover body is provided with a clamping part, and the outer side wall of the clamping part is provided with a thread; the slider body comprises a connecting column and a sliding push piece; the connecting column is rotationally connected in the central through hole, and the sliding push piece is sleeved and fixed on the connecting column and fitted to the top surface of the cup cover body and can be rotated on the top surface of the cup cover body with the connecting column as the center.

9 Claims, 6 Drawing Sheets

INTEGRATED LEAKPROOF CUP COVER FOR DIRECT DRINKING AND DRINKING WITH STRAW AND CUP HAVING SAME

CROSS REFERENCE TO RELATED APPLICATION

This patent application claims the benefit and priority of Chinese Patent Application No. 2023212243314 filed on May 19, 2023, the disclosure of which is incorporated by reference herein in its entirety as part of the present application.

TECHNICAL FIELD

The present invention relates to a cover body, and more particularly relates to an integrated leakproof cup cover for direct drinking and drinking with a straw and a cup having the same.

BACKGROUND

In order to prevent dust and foreign objects from falling into the cup and prevent the liquid in the cup from overflowing, a cover body is generally arranged at the opening of the cup. Different connection modes of the cover body and the cup can realize different closing effects. Most of the commonly used connection modes of the cover body and the cup are threaded connection, and it is necessary to unscrew the cup cover to drink. If the operation is not proper, the liquid in the cup will spill out, causing inconvenience, and the function is single.

For example, in the prior art: a patent 202121322560.0, with the title of a leakproof breathable cup cover with the function of a straw hole, comprises a cup cover body, a drinking port stopper and a straw hole plug, wherein the cup cover body is provided with a drinking port and a straw hole slot, the drinking port stopper is installed at the drinking port in the cup cover body, and the straw hole is installed at the straw hole slot in the cup cover body; and the inner bottom of the straw hole slot is provided with a straw hole cover, and the straw hole cover is provided with an internal air hole. The present invention has a cup cover with the function of preventing leakage, which can prevent drinks from leaking from the air hole in the take-out process. The structure arrangement can improve the leakproof effect to a certain extent, but a separate straw is required and cannot be stored after use, resulting in inconvenience.

Therefore, the problem to be urgently solved by those skilled in the art is how to provide a leakproof cup cover which has single structure and good sealing performance, qintegrates direct drinking and drinking with a straw, and is clean and convenient to store a straw.

SUMMARY

In view of this, the present invention provides an integrated leakproof cup cover for direct drinking and drinking with a straw and a cup having the same, aiming to solve the above technical problem.

To achieve the above purpose, the present invention adopts the following technical solution:

An integrated leakproof cup cover for direct drinking and drinking with a straw, comprising:

A cup cover body, wherein the cup cover body has a tubular structure with an opening at the top and a closed bottom, and the bottom wall is provided with a central through hole and a drinking port located on one side of the central through hole; and the bottom of the cup cover body is provided with a clamping part extending downwards, and the outer side wall of the clamping part is provided with a thread;

A slider body, wherein the slider body comprises a connecting column and a sliding push piece; and the connecting column is rotationally connected in the central through hole, and the sliding push piece is sleeved and fixed on the connecting column and fitted to the top surface of the cup cover body and can be rotated on the top surface of the cup cover body with the connecting column as the center to realize the opening and sealing of the drinking port.

With the above technical solution, an integrated leakproof cup cover for direct drinking and drinking with a straw provided by the present invention comprises a cup cover body and a slider body, the cup cover body can be connected to a cup with a thread at the opening of a cup body through a clamping part, the slider body comprises a connecting column and a sliding push piece, the connecting column is rotationally connected in the central through hole formed in the cup cover body, and the sliding push piece is fitted to the top surface of the cup cover body and can be rotated on the top surface of the cup cover body with the connecting column as the center to realize the opening and sealing of the drinking port. The present invention has simple structure and can realize the opening and sealing of the drinking port by pushing the sliding push piece back and forth, with good sealing effect and convenient drinking.

Preferably, in the above integrated leakproof cup cover for direct drinking and drinking with a straw, the sliding push piece comprises an upper push piece and a lower push piece; the upper push piece is fixed at the top of the connecting column, and the upper push piece and the connecting column also can be integrated in one piece; the side wall of the connecting column is provided with a plurality of positioning mounting surfaces equally spaced; and one end of the lower push piece is provided with an annular groove sleeved on the positioning mounting surfaces, and the other end is detachably connected with a silicone pad matched with the drinking port. When the upper push piece is pushed to slide along the cup cover body, the lower push piece and the upper push piece slide at the same time to achieve an effect of double sealing.

Preferably, in the above integrated leakproof cup cover for direct drinking and drinking with a straw, the cup cover body comprises a cover plate and an outer ring body integrated with the cover plate; the cover plate is located between the upper push piece and the lower push piece; and the upper push piece is provided with a sliding end away from one end connected with the connecting column, and the sliding end is slidably connected with the top edge of the outer ring body. The structure is simple, and the arrangement of the sliding end is convenient for pushing the upper push piece so as to realize the opening and sealing of the drinking port.

Preferably, in the above integrated leakproof cup cover for direct drinking and drinking with a straw, the slider body also comprises an annular buckle and a spring; the annular buckle is clamped at the bottom of the connecting column; and the spring is sleeved on the outer side of the connecting column and located between the annular buckle and the lower push piece. The arrangement of the spring is more convenient for the upper push piece and the lower push piece to slide back and forth; and meanwhile, when the spring is connected with the cup and the cup is filled with hot water, upward pressure will be produced to give an upward pushing force to the annular buckle so that the annular buckle compresses the spring to make the lower push piece more fitted to the bottom wall of the cover plate, and the sealing effect is better.

Preferably, in the above integrated leakproof cup cover for direct drinking and drinking with a straw, the top surface and the bottom wall of the cover plate are provided with first clamping grooves and second clamping grooves which are recessed oppositely; and the bottom wall of the upper push piece is provided with first bumps corresponding to the first clamping grooves, and the top surface of the lower push piece is provided with second bumps corresponding to the second clamping grooves. This structure arrangement can ensure that when the upper push piece and the lower push piece slide to seal the drinking port, the silicone pad on the lower push piece is located just in the drinking port, and the upper push piece and the lower push piece are respectively fitted to the top surface and the bottom wall of the cover plate to effectively ensure the sealing effect; and meanwhile, the structure arrangement of the first bumps and the second bumps makes the upper push piece and the lower push piece have a certain gap with the top surface and the bottom wall of the cover plate when the upper push piece and the lower push piece slide to one side of the drinking port, and effectively reduces the friction between the silicone pad and the cover plate when the upper push piece and the lower push piece slide back and forth so that the pushing resistance of the upper push piece and the lower push piece is smaller and the driving is smoother, which extends the service life and saves the cost.

Preferably, in the above integrated leakproof cup cover for direct drinking and drinking with a straw, the number of the first clamping grooves and the number of the second clamping grooves are both three, and the first clamping grooves and the second clamping grooves are arranged on the outer side of the central through hole at an interval of 90°. The structure arrangement can limit the sliding of the upper push piece and the lower push piece and effectively prevent the push pieces from moving left and right.

Preferably, in the above integrated leakproof cup cover for direct drinking and drinking with a straw, the cover plate is provided with a straw slot extending downwards on one side of the central through hole; and a dust cap is in threaded connection in the straw slot. Both the direct drinking port and the straw port are arranged for the user to choose according to the preferences, the dust cap prevents dust, which is clean, and when the user drinks water through the direct drinking port, the dust cap can accommodate the straw.

Preferably, in the above integrated leakproof cup cover for direct drinking and drinking with a straw, the top surface of the connecting column is concave downwards to form an accommodating groove, and the inner side wall of the accommodating groove is provided with a thread corresponding to the dust cap. When the user drinks water through the straw port, the dust cap can be stored in the accommodating groove, which can effectively prevent loss.

Preferably, in the above integrated leakproof cup cover for direct drinking and drinking with a straw, the outer side of the connecting column is sleeved with a seal ring, and the seal ring is abutted with the inner side wall of the central through hole. The sealing performance of the integral structure is effectively guaranteed.

The present invention also provides a cup, comprising a cup body, a leakproof cup cover and a straw, wherein the inner side wall of the opening of the cup body is provided with a thread; and the thread of the clamping part is connected with the thread of the cup body, and the straw is arranged in the cup body.

Preferably, in the above cup, one end of the straw is extended upwards through the straw slot to outside the cover plate, the other end is placed in the cup body, and the end of the straw located in the cup body is connected with a silicone tube. The arrangement of the silicone tube can make the straw telescopic. After the dust cap is screwed, the straw pops out under the action of the silicone tube, and the user can drink water with the straw.

It can be known from the above technical solution that compared with the prior art, the present invention discloses and provides an integrated leakproof cup cover for direct drinking and drinking with a straw and a cup having the same and has the following beneficial effects:

1. In the present invention, the upper push piece is pushed to move back and forth so as to drive the lower push piece slide, and the upper push piece and the lower push piece are fitted to the top surface and the bottom wall of the cover body to achieve a good sealing effect.
2. In the present invention, the structure arrangement of the first clamping grooves, the second clamping grooves, the first bumps and the second bumps makes the silicone pad located in the drinking port when the upper push piece and the lower push piece slide to seal the drinking port, which better guarantees the sealing effect; and meanwhile, the structure arrangement of the first bumps and the second bumps makes the upper push piece and the lower push piece have a certain gap with the top surface and the bottom wall of the cover plate when the upper push piece and the lower push piece slide to one side of the drinking port, which reduces the sliding friction, extends the service life and saves the cost.
3. In the present invention, the arrangement of the annular buckle and the spring makes the hot water in the cup form upward pressure in the cup to give an upward pushing force to the annular buckle when the leakproof cup cover is connected with the cup so that the annular buckle compresses the spring to make the lower push piece more fitted to the bottom wall of the cover plate, and the sealing effect is better.
4. The present invention has two drinking methods of direct drinking and drinking with a straw, and can effectively prevent water leakage. When the user chooses to directly drink water through the drinking port, the dust cap can directly store the straw in the cup without the need of a separate straw, which is convenient for storage. In a completely sealed state, the cup can be placed in a bag for easy carrying out.

DESCRIPTION OF DRAWINGS

To more clearly describe the technical solutions in the embodiments of the present invention or in the prior art, the drawings required to be used in the description of the embodiments or the prior art will be simply presented below. Apparently, the drawings in the following description are merely embodiments of the present invention, and for those ordinary skilled in the art, other drawings can also be obtained according to the drawings without contributing creative labor.

In the figures.

1-cup cover body;

11-cover plate; 111-first clamping groove; 112-second clamping groove; 12-outer ring body;

2-central through hole;

3-drinking port;

4-clamping part;

5-slider body,

51-connecting column; 511-positioning mounting surface; 512-accommodating groove; 52-sliding push piece; 521-upper push piece; 5211-first bump; 522-lower push piece; 5222-second bump; 523-annular groove; 524-sliding end; 53-annular buckle; 54-spring;

6-silicone pad;

7-straw slot;

71-straw; 72-silicone tube

8-dust cap;

9-seal ring.

DETAILED DESCRIPTION

The technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Embodiment 1

Figure 1:
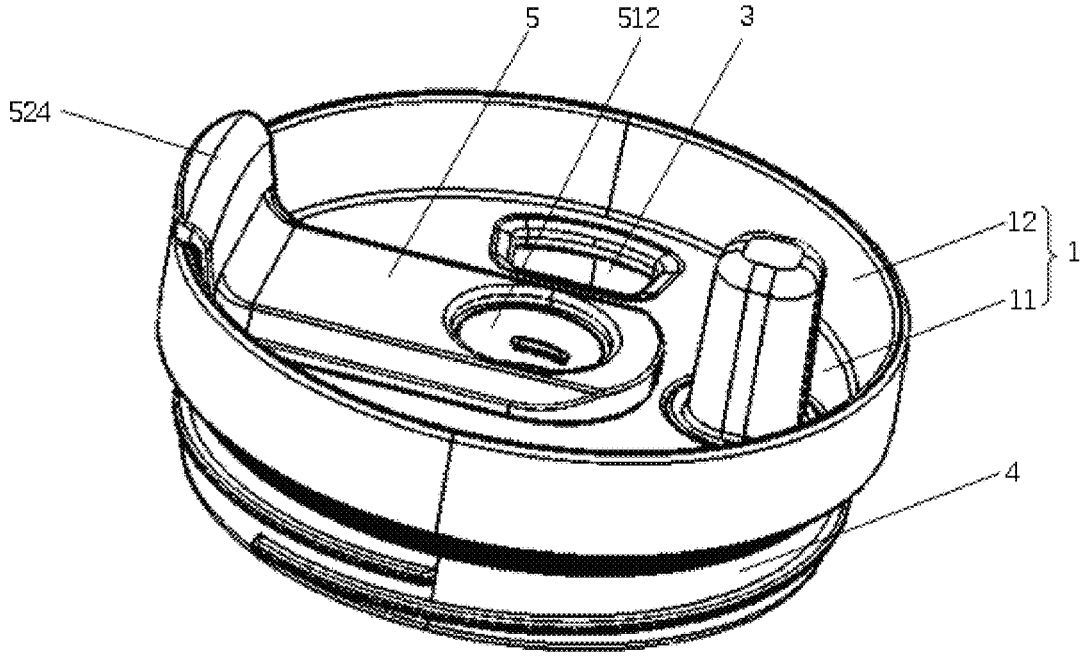
FIG. 1 is an isometric view of a leakproof cup cover provided by the present invention.
Figure 2:
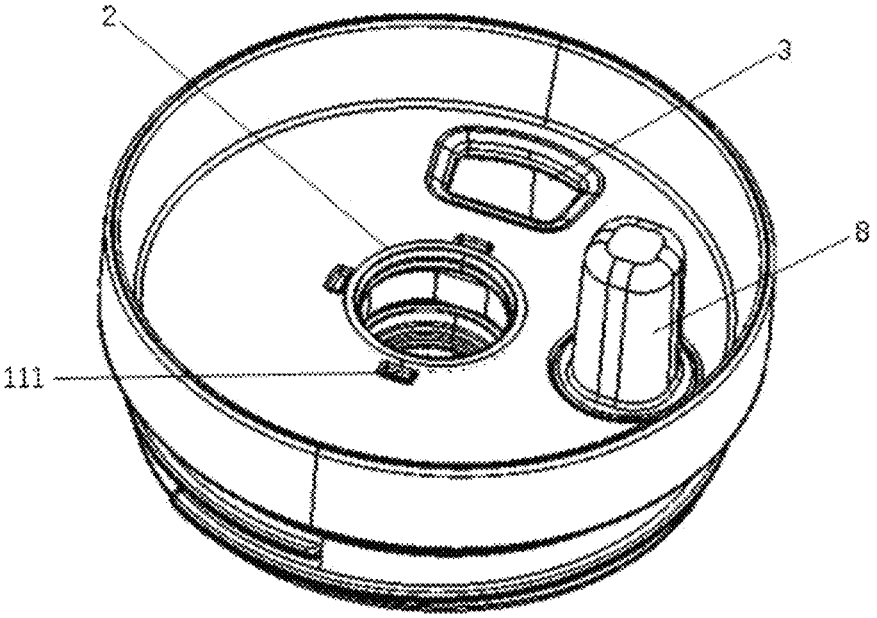
FIG. 2 is a structural schematic diagram of a leakproof cup cover provided by the present invention from another point of view.
Figure 3:
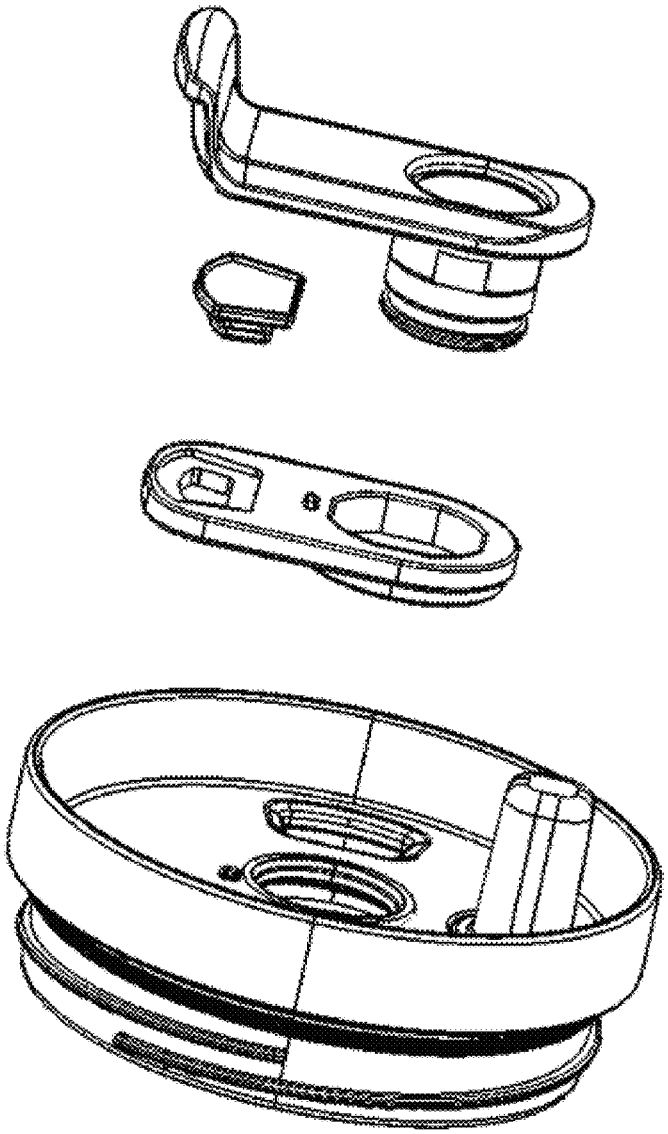
FIG. 3 is an exploded view of a leakproof cup cover provided by the present invention.
Figure 4:
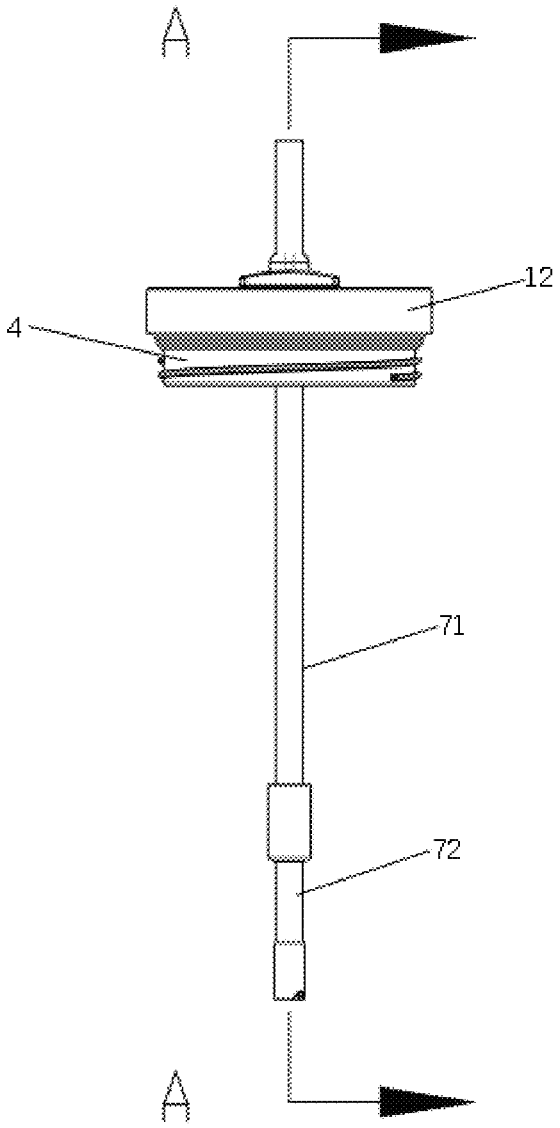
FIG. 4 is a front view of a leakproof cup cover (with a straw) provided by the present invention.
Figure 5:
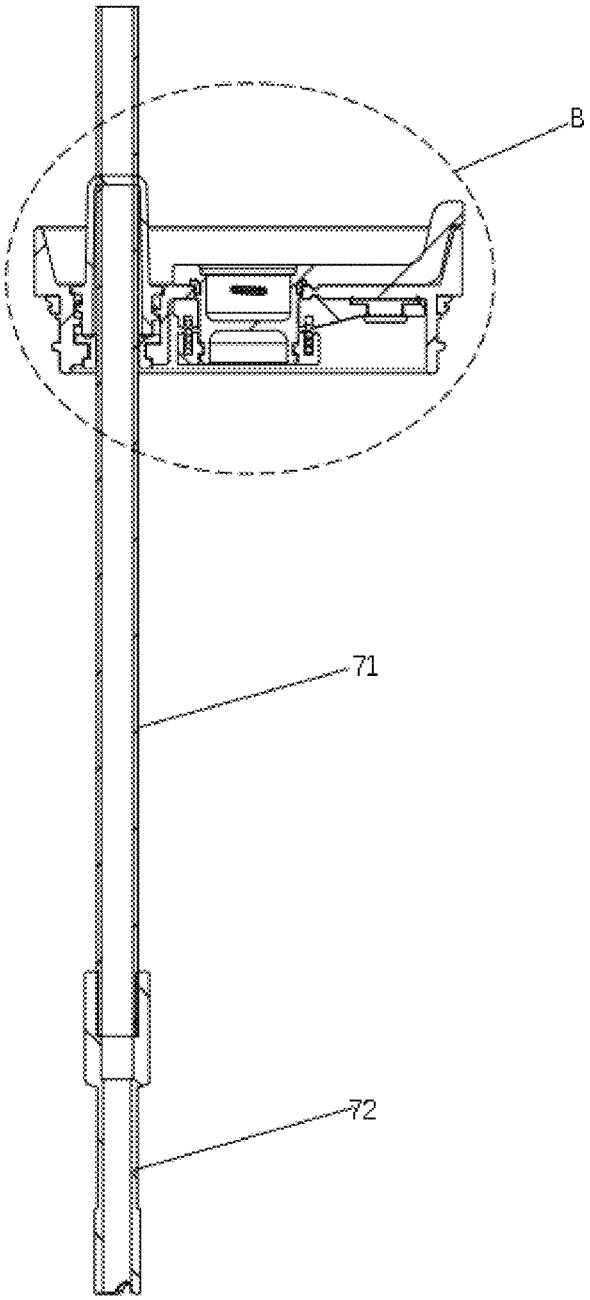
FIG. 5 shows a section A-A of FIG. 4.
Figure 6:
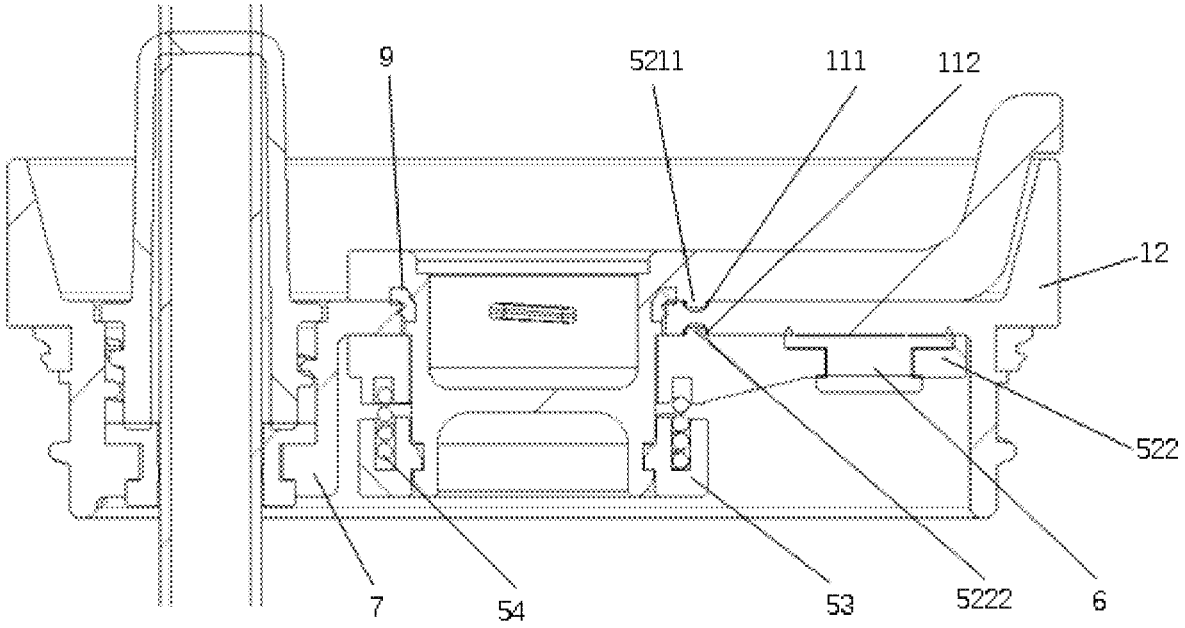
FIG. 6 is an enlarged view of a section B of FIG. 5.

With reference to FIG. 1 to FIG. 6, the present invention discloses an integrated leakproof cup cover for direct drinking and drinking with a straw, comprising:

A cup cover body 1, wherein the cup cover body 1 has a tubular structure with an opening at the top and a closed bottom, and the bottom wall is provided with a central through hole 2 and a drinking port 3 located on one side of the central through hole 2; and the bottom of the cup cover body 1 is provided with a clamping part 4 extending downwards, and the outer side wall of the clamping part 4 is provided with a thread;

A slider body 5, wherein the slider body 5 comprises a connecting column 51 and a sliding push piece 52; and the connecting column 51 is rotationally connected in the central through hole 2, and the sliding push piece 52 is sleeved and fixed on the connecting column 51 and fitted to the top surface of the cup cover body 1 and can be rotated on the top surface of the cup cover body 1 with the connecting column 51 as the center to realize the opening and sealing of the drinking port 3.

To further optimize the above technical solution, the sliding push piece 52 comprises an upper push piece 521 and a lower push piece 522; the upper push piece 521 is fixed at the top of the connecting column 51; the side wall of the connecting column 51 is provided with a plurality of positioning mounting surfaces 511 equally spaced; and one end of the lower push piece 522 is provided with an annular groove 523 sleeved on the positioning mounting surfaces 511, and the other end is detachably connected with a silicone pad 6 matched with the drinking port 3.

To further optimize the above technical solution, the cup cover body 1 comprises a cover plate 11 and an outer ring body 12 integrated with the cover plate 11; the cover plate 11 is located between the upper push piece 521 and the lower push piece 522; and the upper push piece 521 is provided with a sliding end 524 away from one end connected with the connecting column 51, and the sliding end 524 is slidably connected with the top edge of the outer ring body 12.

To further optimize the above technical solution, the slider body 5 also comprises an annular buckle 53 and a spring 54; the annular buckle 53 is clamped at the bottom of the connecting column 51; and the spring 54 is sleeved on the outer side of the connecting column 51 and located between the annular buckle 53 and the lower push piece 522.

To further optimize the above technical solution, the top surface and the bottom wall of the cover plate 11 are provided with first clamping grooves 111 and second clamping grooves 112 which are recessed oppositely; and the bottom wall of the upper push piece 521 is provided with first bumps 5211 corresponding to the first clamping grooves 111, and the top surface of the lower push piece 522 is provided with second bumps 5222 corresponding to the second clamping grooves 112.

To further optimize the above technical solution, the number of the first clamping grooves 111 and the number of the second clamping grooves 112 are both three, and the first clamping grooves 111 and the second clamping grooves 112 are arranged on the outer side of the central through hole 2 at an interval of 90°.

To further optimize the above technical solution, the cover plate 11 is provided with a straw slot 7 extending downwards on one side of the central through hole 2; and a dust cap 8 is in threaded connection in the straw slot 7.

To further optimize the above technical solution, the top surface of the connecting column 51 is concave downwards to form an accommodating groove 512, and the inner side wall of the accommodating groove 512 is provided with a thread corresponding to the dust cap 8.

To further optimize the above technical solution, the outer side of the connecting column 51 is sleeved with a seal ring 9, and the seal ring 9 is abutted with the inner side wall of the central through hole 2.

Embodiment 2

The present invention discloses a cup, comprising a cup body, a leakproof cup cover and a straw 71; the inner side wall of the opening of the cup body is provided with a thread; and the thread of the clamping part 4 is connected with the thread of the cup body, and the straw 71 is arranged in the cup body.

To further optimize the above technical solution, one end of the straw 71 is extended upwards through the straw slot 7 to outside the cover plate 11, the other end is placed in the cup body, and the end of the straw 71 located in the cup body is connected with a silicone tube 72. The arrangement of the silicone tube 72 can make the straw 71 telescopic. After the dust cap 8 is screwed, the straw 71 pops out under the action of the silicone tube 72, and the user can drink water with the straw 71.

A method for using the present invention is as follows:

In the initial state, the drinking port 3 is sealed by the upper push piece 521 and the lower push piece 522; and the dust cap 8 is in threaded connection with the straw slot 7;

When the user drinks water through the drinking port 3, the dust cap 8 is buckled on one end of the straw 71 located outside the cover plate 11 to press the end into the straw slot 7, which effectively ensures the cleanness and storage of the straw; the upper push piece 521 is pushed to rotate by 90°, the lower push piece 522 rotates by 90° synchronously, and then the user can drink water through the drinking port 3; and after drinking, the upper push piece 521 is rotated by 90° in the opposite direction to seal the drinking port 3;

When the user drinks water with the straw 71, the drinking port 3 is sealed by the upper push piece 521 and the lower push piece 522; and the dust cap 8 is unscrewed and placed in the accommodating groove 512, the silicone tube 72 gives an upward elastic force to the straw 71 so that the straw 71 is extended outside the cover plate 11, and then the user can drink water with the straw 71.

Each embodiment in the description is described in a progressive way. The difference of each embodiment from each other is the focus of explanation. The same and similar parts among all of the embodiments can be referred to each other. For the device disclosed by the embodiment, because the device corresponds to the method disclosed by the embodiment, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. An integrated leakproof cup cover for direct drinking and drinking with a straw, comprising: a cup cover body (1), wherein the cup cover body (1) has a tubular structure with an opening at a top and a closed bottom, and a bottom wall is provided with a central through hole (2) and a drinking port (3) located on one side of the central through hole (2); and the bottom of the cup cover body (1) is provided with a clamping part (4) extending downwards, and the outer side wall of the clamping part (4) is provided with a thread;

a slider body (5), wherein the slider body (5) comprises a connecting column (51) and a sliding push piece (52); and the connecting column (51) is rotationally connected in the central through hole (2), and the sliding push piece (52) is sleeved and fixed on the connecting column (51) and fitted to the top surface of the cup cover body (1) and can be rotated on the top surface of the cup cover body (1) with the connecting column (51) as the center to realize the opening and sealing of the drinking port (3).

2. The integrated leakproof cup cover for direct drinking and drinking with a straw according to claim 1, wherein the sliding push piece (52) comprises an upper push piece (521) and a lower push piece (522); the upper push piece (521) is fixed at the top of the connecting column (51); the side wall of the connecting column (51) is provided with a plurality of positioning mounting surfaces (511) equally spaced; and one end of the lower push piece (522) is provided with an annular groove (523) sleeved on the positioning mounting surfaces (511), and the other end is detachably connected with a silicone pad (6) matched with the drinking port (3).

3. The integrated leakproof cup cover for direct drinking and drinking with a straw according to claim 2, wherein the cup cover body (1) comprises a cover plate (11) and an outer ring body (12) integrated with the cover plate (11); the cover plate (11) is located between the upper push piece (521) and the lower push piece (522); and the upper push piece (521) is provided with a sliding end (524) away from one end connected with the connecting column (51), and the sliding end (524) is slidably connected with the top edge of the outer ring body (12).

4. The integrated leakproof cup cover for direct drinking and drinking with a straw according to claim 2, wherein the slider body (5) also comprises an annular buckle (53) and a spring (54); the annular buckle (53) is clamped at the bottom of the connecting column (51); and the spring (54) is sleeved on the outer side of the connecting column (51) and located between the annular buckle (53) and the lower push piece (522).

5. The integrated leakproof cup cover for direct drinking and drinking with a straw according to claim 3, wherein the top surface and the bottom wall of the cover plate (11) are provided with first clamping grooves (111) and second clamping grooves (112) which are recessed oppositely; and the bottom wall of the upper push piece (521) is provided with first bumps (5211) corresponding to the first clamping grooves (111), and the top surface of the lower push piece (522) is provided with second bumps (5222) corresponding to the second clamping grooves (112).

6. The integrated leakproof cup cover for direct drinking and drinking with a straw according to claim 5, wherein the number of the first clamping grooves (111) and the number of the second clamping grooves (112) are both three, and the first clamping grooves (111) and the second clamping grooves (112) are arranged on the outer side of the central through hole (2) at an interval of 90°.

7. The integrated leakproof cup cover for direct drinking and drinking with a straw according to claim 3, wherein the cover plate (11) is provided with a straw slot (7) extending downwards on one side of the central through hole (2); a dust cap (8) is in threaded connection in the straw slot (7); and the top surface of the connecting column (51) is concave downwards to form an accommodating groove (512), and the inner side wall of the accommodating groove (512) is provided with a thread corresponding to the dust cap (8).

8. The integrated leakproof cup cover for direct drinking and drinking with a straw according to claim 2, wherein the outer side of the connecting column (51) is sleeved with a seal ring (9), and the seal ring (9) is abutted with the inner side wall of the central through hole (2).

9. A cup, comprising a cup body, the integrated leakproof cup cover for direct drinking and drinking with a straw of claim 1, and a straw (71); the inner side wall of the opening of the cup body is provided with a thread; the thread of the clamping part (4) is connected with the thread of the cup body; and the straw (71) is arranged in the cup body.

* * * * *